US008088181B2

(12) United States Patent
Park

(10) Patent No.: US 8,088,181 B2
(45) Date of Patent: Jan. 3, 2012

(54) DYEING METHOD FOR RAISING BLUE COLOR

(75) Inventor: Sungeun Park, Seoul (KR)

(73) Assignees: Sungeun Park, Seoul (KR); Yunha Lee, Uijeongbu-si (KR); Ecoyaa Co., Ltd., Icheon-si, Gyeonggi-do (KR)

( * ) Notice: Subject to any disclaimer, the term of this patent is extended or adjusted under 35 U.S.C. 154(b) by 0 days.

(21) Appl. No.: 13/122,486

(22) PCT Filed: Oct. 9, 2009

(86) PCT No.: PCT/KR2009/005776

§ 371 (c)(1),
(2), (4) Date: Apr. 4, 2011

(87) PCT Pub. No.: WO2010/044568

PCT Pub. Date: Apr. 22, 2010

(65) Prior Publication Data

US 2011/0185518 A1 Aug. 4, 2011

(30) Foreign Application Priority Data

Oct. 13, 2008 (KR) ..... 10-2008-0100253

(51) Int. Cl.
*C09B 61/00* (2006.01)
*C09B 65/00* (2006.01)

(52) U.S. Cl. ..... 8/646; 8/623

(58) Field of Classification Search ..... 8/646, 623
See application file for complete search history.

(56) References Cited

U.S. PATENT DOCUMENTS 2,005,697 A 6/1935 Grover
2,215,196 A * 9/1940 Schlack ..... 8/558

OTHER PUBLICATIONS

International Search Report, Appln No. PCT/KR2009/005776, dated Apr. 1, 2010.

* cited by examiner

*Primary Examiner* — Amina Khan
(74) *Attorney, Agent, or Firm* — Kile Park Goekjian Reed & McManus PLLC

(57) ABSTRACT

A dyeing method for raising a blue color is provided. The method includes dyeing fabric with raw dye, ferro-mordanting the fabric having undergone the dyeing of raw dye with ferro-mordant, producing potassium ferrocyanide solution by dissolving potassium ferrocyanide in water, and putting the fabric having undergone the ferro-mordanting into the solution obtained in the potassium ferrocyanide solution production and then ripening the fabric until a blue color of a desired tone is raised. Accordingly, a stabilized dyeing state of blue color group is easily got even using natural dyeing materials as material difficult to raise a blue color on fabric.

6 Claims, 10 Drawing Sheets

DYEING METHOD FOR RAISING BLUE COLOR

TECHNICAL FIELD

The present invention relates to a dyeing method, and more particularly, to a dyeing method for raising blue color using natural dye.

BACKGROUND ART

A dyeing means dyeing fiber or cloth with a specific color by using dyes. Unlike the past using only natural materials got naturally, today various kinds of artificially produced synthetic dyes with various colors are used for various colors of expression. Nowadays, most of dyeing processes are performed including such artificially produced synthetic dyes.

The technical development for representing most of imaginable colors has been done including various developments of processes and materials relating to an improvement of dyeing technology with dyes. In this regard, the merit of dyeing processes using the artificially-produced synthetic dyes is greatly spotlighted, meanwhile the dyeing processes using natural dyes also keeps its independent position in light of a natural coloring expression, the harmony with natural fiber products, a harmlessness to the human body by using environment-friendly materials.

In the dyeing using natural dyes, in general, a mordanting process is included to solve a coloring fixing problem of dye taken naturally. A mordanting is to process fiber to become colored by using agent to generate an insoluble color composite through a combination with dye when dye does not have a color fixing capability to fiber or is weak to its coloring characteristic level.

DISCLOSURE OF INVENTION

Technical Problem

However, even though such mordanting process has been done, a coloring expression has a limit in dyeing due to the use of natural dyes. This is why there is a limit in a kind of colors from dyes itself gathered in the natural state, and furthermore, there is a limit in materials capable of being coloring-fixed on fiber or cloth even though the mordanting process has been done.

Representative color of natural dyes difficult to get an appropriate coloring expression is a blue color. That is, in natural dyes used traditionally a dye of the blue group is rare, further a dyeing of the blue group is difficult owing to a problem of color fixing level, etc.

Despite the above mentioned merits of natural dyes, a dyeing using the natural dyes is limited to a few of traditional colors. Furthermore, the development of a dyeing process and for a selection of appropriate dye relating to a dyeing method to represent a coloring of the blue group has not gone well.

Solution to Problem

The present invention relates to a dyeing method for raising a blue color, capable of obtaining various kinds of blue groups in dyeing even using natural dyes etc.

Accordingly, some embodiments of the invention provide a dyeing method for raising a blue color.

Advantageous Effects of Invention

In accordance with embodiments of the invention, the dyeing method for raising a blue color enables fabric to be dyed easily and stably in dyeing with dyes of a blue group, even using natural dyeing material which is difficult to raise blue color in dyeing.

Further, a dyeing of blue group can be approached to various kinds of color feeling from blue by appropriately selecting and controlling raw dyes and impregnation time etc.

BRIEF DESCRIPTION OF DRAWINGS

The present invention will become more fully understood from the detailed description given hereinbelow and the accompanying drawings which are given by way of illustration, and thus are not limitative of the present invention, and wherein.

BEST MODE FOR CARRYING OUT THE INVENTION

Figure 1:
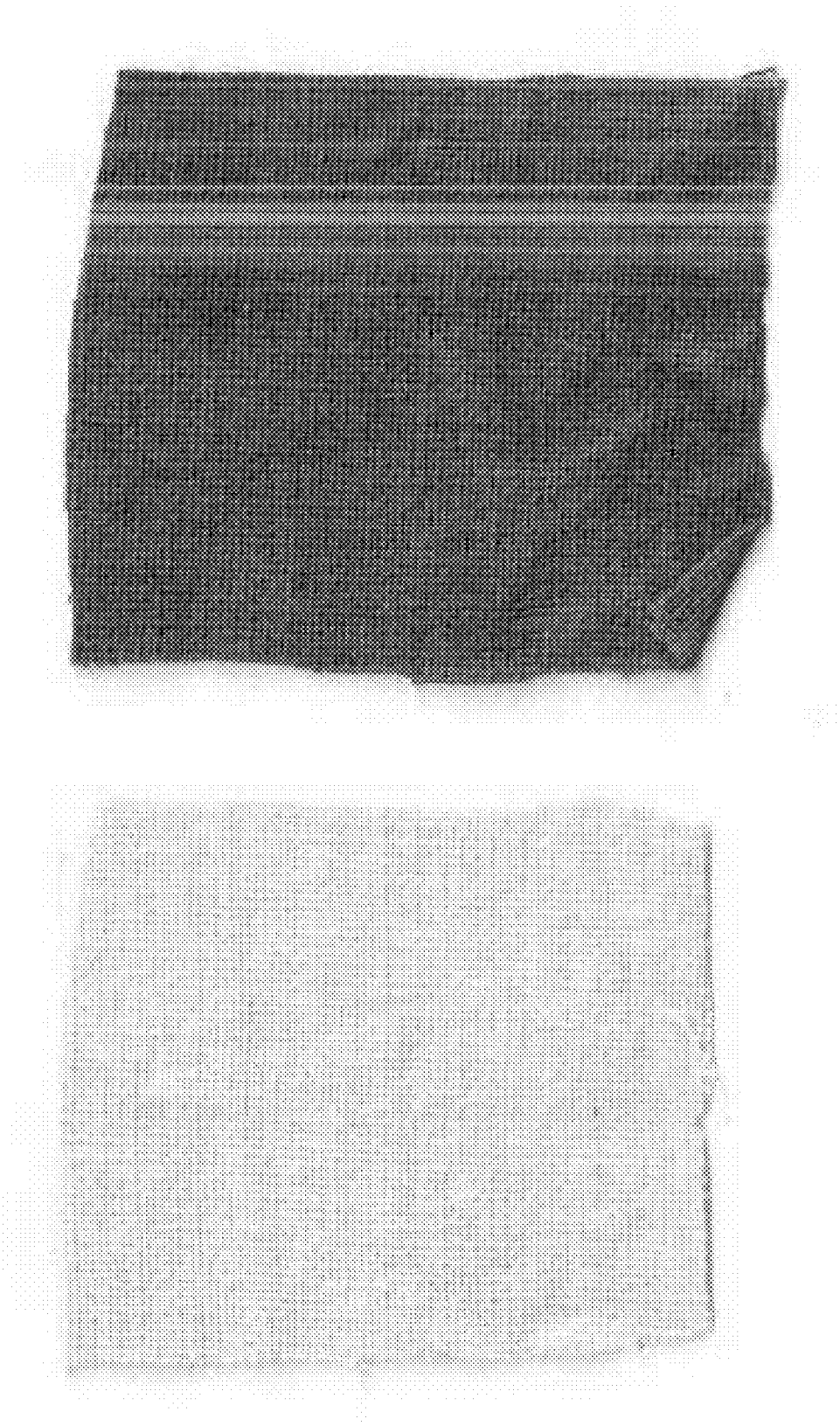
FIGS. 1 to 10 are photos showing a dyeing state of fabric dyed in accordance with an embodiment of the invention, respectively using raw dyes of annatto, gall, *Mallotus japonicus*, acacia, rhubarb, sandalwood, madder, pomegranate, catechu and persimmon tannin.

The dyeing method comprises dyeing fabric with raw dye, ferro-mordanting the fabric having undergone the dyeing of raw dye with ferro-mordant, producing potassium ferrocyanide solution by dissolving potassium ferrocyanide in water, and putting the fabric having undergone the mordanting of ferro-mordant into the solution obtained in the potassium ferrocyanide solution production and then ripening the fabric until a blue color of a desired tone is raised.

Raw material of the dyes may be at least one of persimmon, madder, gardenia, chestnut, gromwell, gall, annatto, mallotus japonicus, acacia, rhubarb, sandalwood, pomegranate, catechu, and wine.

The ferro-mordanting of the fabric using ferro-mordant may comprise dissolving ferro-mordant agent in water of normal temperature, impregnating the fabric having undergone the dyeing of raw dye into solution got through the ferro-mordant agent dissolving, and then slowly increasing temperature of the solution to 50° C. to 100° C. after the fabric impregnation.

The ferro-mordant agent used in the ferro-mordanting may be $FeSO_4$.

FeS04 used in the ferro-mordanting may have 1 to 20 weight percent to 100 weight percent of the fabric.

On the other hand, the potassium ferrocyanide used in the potassium ferrocyanide solution production may have 1 to 20 weight percent to 100 weight percent of the fabric.

MODE FOR THE INVENTION

Embodiments of the inventive concept now will be described more fully hereinafter with reference to the accompanying drawings, in which embodiments of the inventive concept are shown. The inventive concept may, however, be embodied in many different forms and should not be construed as limited to the embodiments set forth herein. Rather these embodiments are provided so that this disclosure will be thorough and complete, and will fully convey the inventive scope to those skilled in the art.

A dyeing method for raising a blue color is described more in detail through experimental example and the accompanying drawings in accordance with an embodiment of the invention, as follows.

A wording of 'fabric' cited in the present invention hereby indicates just an object to be dyed using dyes, such as various kinds of fiber, cloth etc. as dyed targets, without a specific limit to the 'fabric'.

In accordance with an embodiment of the present invention, a dominant coloring and a raising effect of blue color using even natural dye are provided, thus dyes used in the present invention mainly are the dyes gatherable directly in a natural state, but the present invention is configured to validate a raising of blue color through a particular additional characteristic only in an embodiment of the invention as it will be described in the below explanation. Therefore, the dyes may be diversely applied as ones preliminarily processed from a natural state or generally-used dyes in accordance with an embodiment of the invention without deviating from the scope of the invention.

Although it is not necessarily required to describe and limit dyes applicable to the invention, in mainly describing natural dyes applicable to the invention there may be described the following example.

1. Persimmon (Persimmon Tannin)

Persimmon is fruit growing on persimmon tree and contains large percentages of grape sugar and fruit sugar, and contains a tannin ingredient of Dios Principe with puckery taste. Besides the persimmon contains pectin, carotenoids etc. In dyeing using persimmon tannin, color of a brown group is raised on fabric.

2. Madder

Madder is as *Rubia akane* Nakai and called a rake leaf as vine plant of perennial of a madder family blooming in light yellow color. Its root is mostly used as dyeing material.

3. Gardenia

Gardenia tree is also a evergreen shrub of madder family and its fruit is called gardenia. From the past, this has been used as a colorant of food etc.

4. Chestnut

Chestnut is fruit of a chestnut tree and contains carbohydrate, protein, various kinds of fats, calcium, vitamin etc. Tannin got from the shell is used for dyeing or a leather process etc.

5. Gromwell

Gromwell is root of *lithospermum erythrorhizon* as perennial of dicotyledon tubiflorae boraginaceae, and may be used as medicinal stuff in the herbal medicine, and has been used as purple dye from the past.

6. Gall

Gall is called insect gall obtained by a characteristic that *schlechtendalia chinenis* Bell of hemiptera greenfly family is parasitic on leaves of *rhus javanica* (gall tree) of lacquer tree. Gall contains tannin ingredient of 50 to 60 percent, and thus gall may be used as raw material of hair-dyeing agent or ink, together with tannin agent.

7. Annatto

Annatto is spice made by using seed of safflower tree. Red got by melting a seed shell of safflower tree in water or oil is mainly used as colorant.

8. *Mallotus japonicus*

*Mallotus japonicus* is deciduous arborescent of dicotyledon archichlamydeae herbrobert spurge family, and contains much tannin ingredient in the shell of tree.

9. Acacia

Acacia is an evergreen tree as one genus of dicotyledon rosales fabaceae, and contains tannin ingredient. Catechu as a kind of plant dyes is extracted from acacia and may be used as antidiarrhea, dye, astringent and tannin agent etc. When the acacia is used as medicine, it may be called catechu to be described below.

10. Catechu

Catechu indicates medicine got by boiling off contents of acacia antechu or catechu tree, or leaves or branches of acacia or mimosa etc. in the herbal medicine. Catechu may be used as antipyretic drug, digestant, hemostatic etc. as the medicinal stuff, and have been also used as raw material of brown dye and for a leather industry.

11. Rhubarb

Rhubarb is perennial of a knotgrass family of a knotgrass order of archichlamydeae. In the herbal medicine, rhubarb indicates medicinal stuff got by removing shells of main root lapsed 6 to 7 years and fine roots having a burdock shape and then by slicing intact or in whole and then drying it. It has light mud yellow color.

12. Sandalwood

Sandalwood coloring matter can be obtained after extracting in a water state from sandalwood, and appears as red in acidity and as purple in alkalinity.

13. Pomegranate

Pomegranate is fruit of *punica granatum* and contains grape sugar, fruit sugar and citric acid etc. Shell contains tannin, and seed may contain estrogen as a natural vegetable property. From the past, its fruit juice has a beautiful color, and thus is good for coloring of food, wine etc.

14. Wine

Wine is fruit wine obtained by fermenting grape or grape juice, and color of red or purple group generally appears.

In accordance with an embodiment of the invention it starts from dyeing fabric with raw dyes. As described above, various kinds of dyes may be used as raw dyes for dyeing fabric in accordance with an embodiment of the invention. That is, a dyeing adequate to the properties of respective dyes may be selected according to a conventional dyeing method, and then fabric dyes primarily.

In the ferro-mordanting using ferro-mordant, subsequently, fabric having undergone the dyeing of raw dye is mordanted with the ferro-mordant.

The ferro-mordant is a kind of the above-described mordant and means a mordanting carried out by using ferro-mordant agent as a basic mordant of iron salt. From old times the ferro-mordant has been generally used for dyeing cotton and silk. Through such dyeing procedure, fabric is tinged with color of a dark group such as black or gray etc.

Ferro-mordant agent may be $FeSO_4$, $FeCl_2$, $Fe(CH_3COO)_2$) etc. $FeSO_4$ may be called green vitriol as a crystal state of light green and is a mainly-used ferro-mordant since solubility to water is good.

Since the fabric becomes relatively weak when a mordanting time is prolonged relatively, it is desirable to perform the mordanting by using a relatively small amount of ferro-mordant in a relatively short time. For that, the ferro-mordant is used with a range of 1 to 20 weight percent to the weight of fabric in accordance with an embodiment of the invention, and further a heating process is included in the ferromordanting process, thereby speedily and definitely executing the mordanting process.

That is, ferro-mordant agent of 1 to 20 weight percent to fabric, desirably 3 to 5 weight percent to fabric, is put into water of the normal temperature and dissolved therein. Then, the fabric having undergone the dyeing of raw dye is impregnated with the solution, and temperature of the solution slowly increases to 50 to 100° C., thereby resulting in a desirable ferro-mordant processing.

Color of the fabric represents black or gray by performing the ferro-mordanting on the fabric having undergone the dyeing of raw dye, thus bright color after the dyeing of raw dye becomes a color level down so as not to be distinguishable by eyes, but a color difference through the dyeing of raw dye gives a finer difference of color sense to blue color raised later.

The formal compound name of potassium ferrocyanide in making potassium ferrocyanide solution used in the raising of blue color in accordance with an embodiment of the invention, is potassium hexacyanoferrate(II) ($K_4[Fe(CN)_6]$), and may be called potassium ferrocyanide, which may be used an ingredient for raising a blue color on the mineral such as jewel from the past.

That is, in raising a blue color on fabric using a natural dye as an important purpose of the present invention, a principal theoretical foundation is regarded as being based on a mechanism that a blue color is raised on fabric by a mutual reaction between the potassium ferrocyanide and iron element ingredient etc. of fabric having undergone the ferro-mordanting like in raising a blue color of mineral through the potassium ferrocyanide. Accordingly, the raising of blue color through potassium ferrocyanide solution may be a main characteristic constitution of the invention.

the fabric dyed after the dyeing of raw dye is put into a corresponding solution of around 30° C., and its temperature increased to around 80° C. At this time, the process took about 30 to 40 minutes.

4) Making Potassium Ferrocyanide Solution

Potassium ferrocyanide of 3 to 5 weight percent rate to fabric of 100 weight percent was dissolved in cold water to be evenly mixed.

5) Raising of Blue Color

The fabric revealing a gray group after the ferro-mordanting was put into the potassium ferrocyanide solution. It took several minutes or shorter to reveal blue color on the fabric put into the solution. Further, it took 1 minute or less to reveal the blue color. At this time, in order to obtain a desired coloring, this time was controlled as 1 minute to 20 minutes.

6) Conclusion

The result from the above experiment is provided in the following Table 2.

TABLE 2

Figure 2:
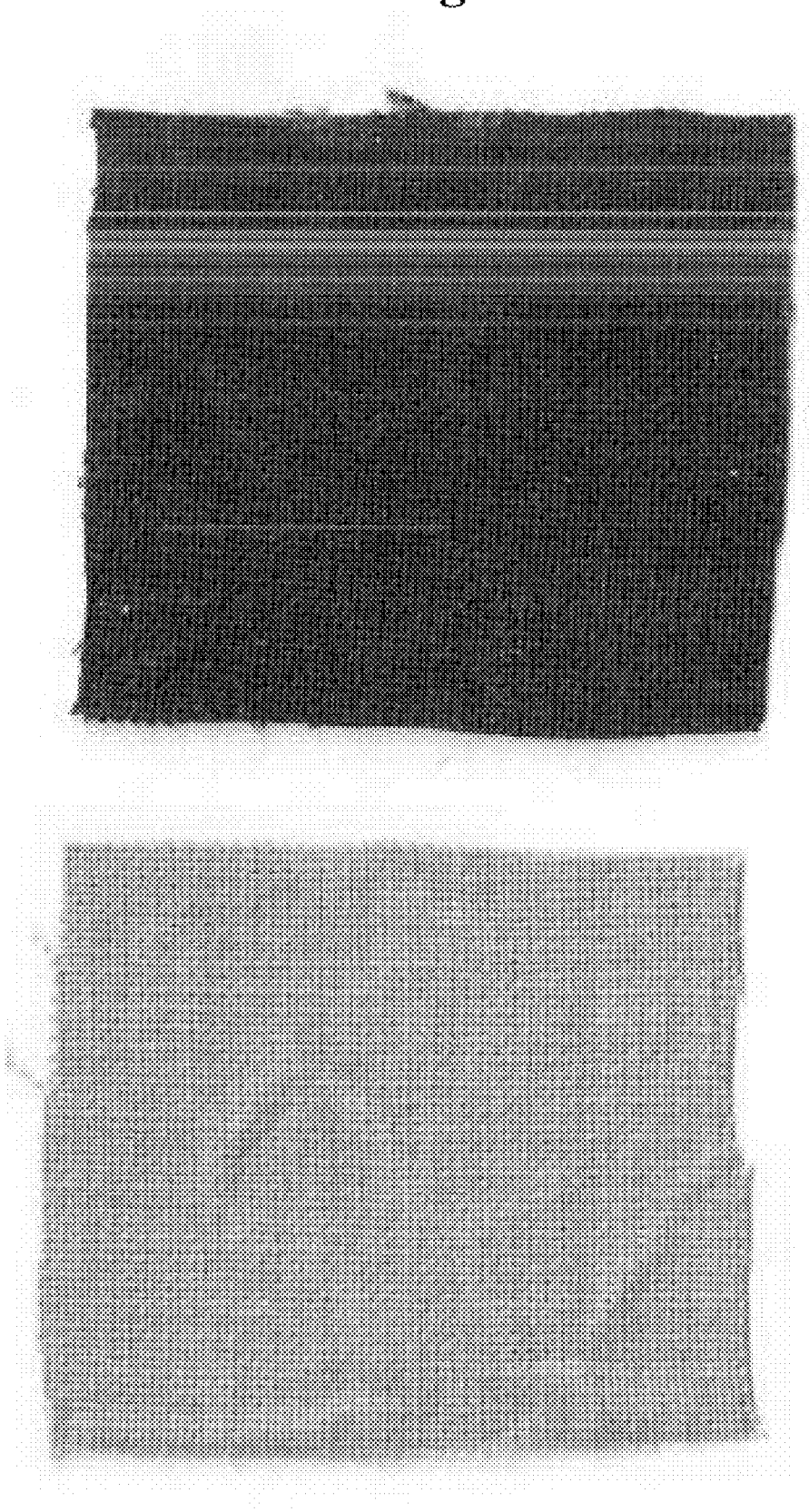
Figure 3:
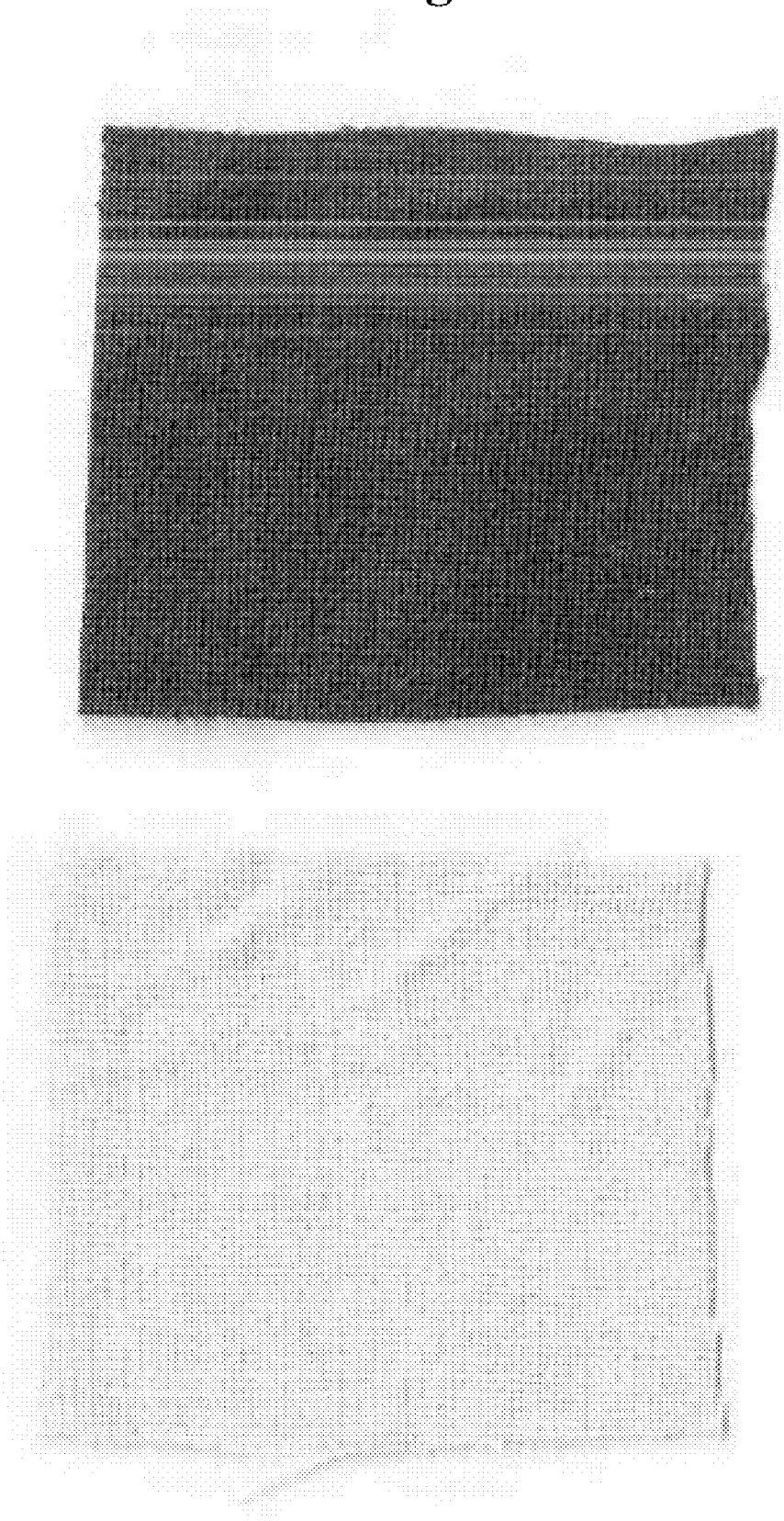
Figure 4:
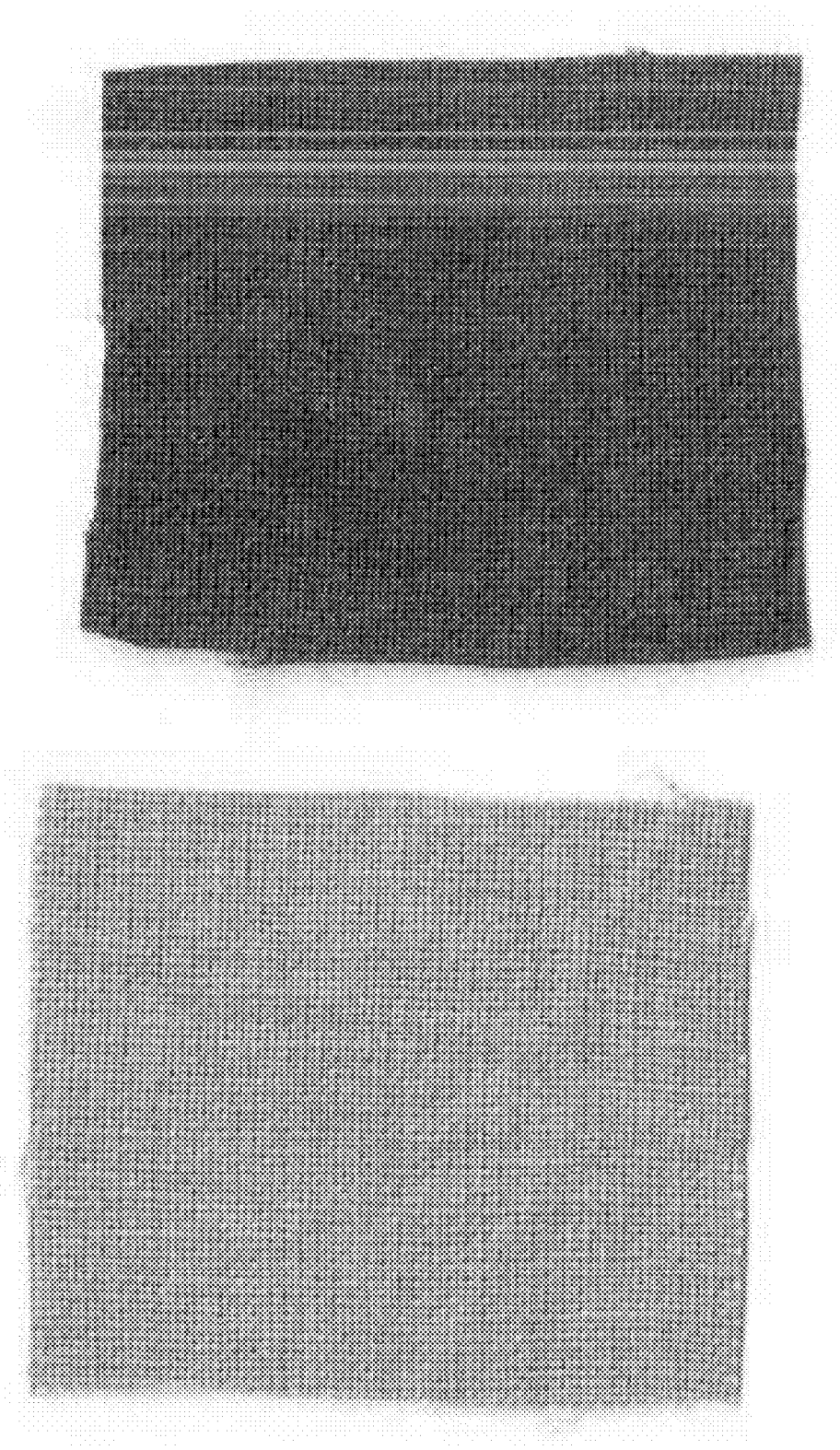
Figure 5:
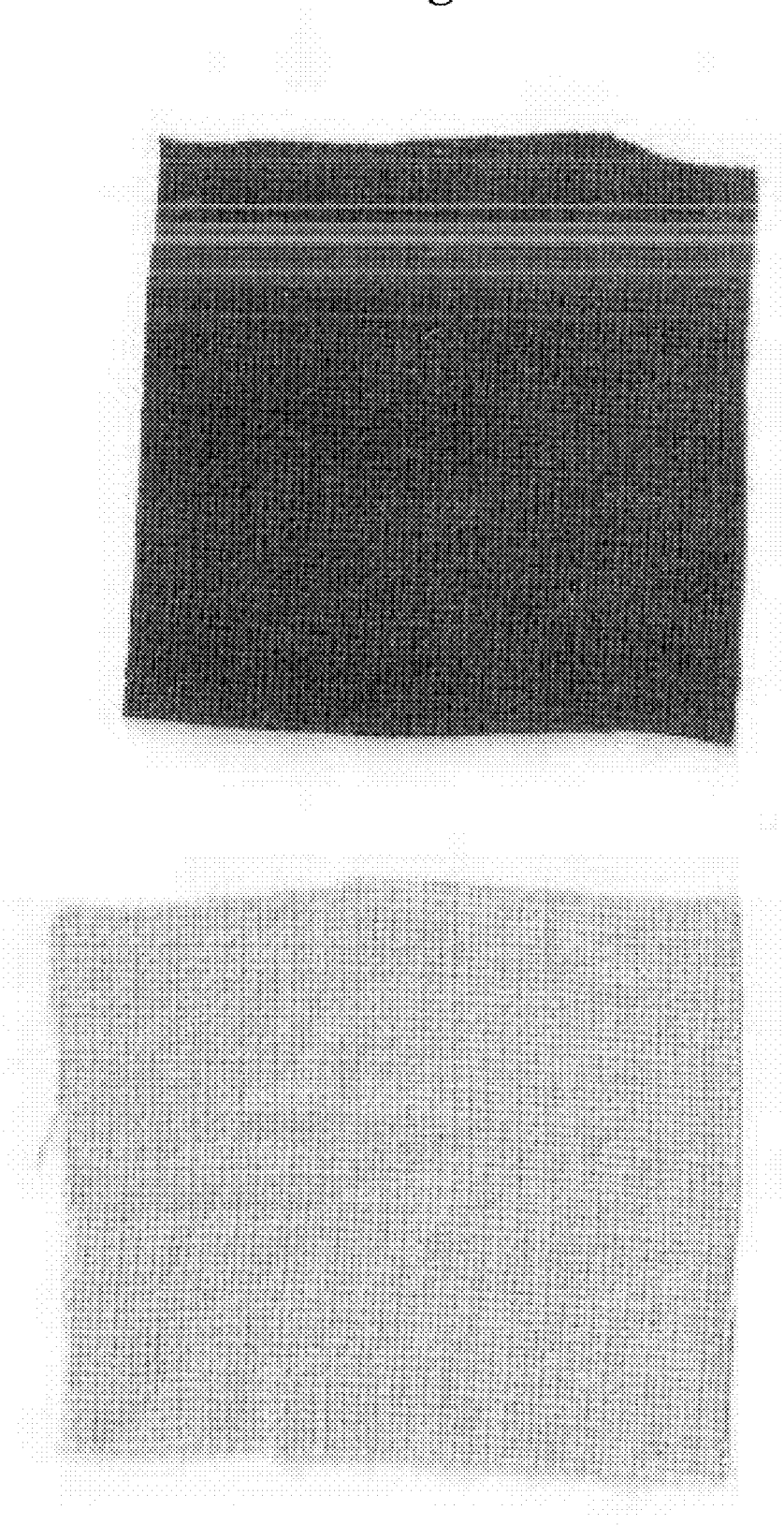
Figure 6:
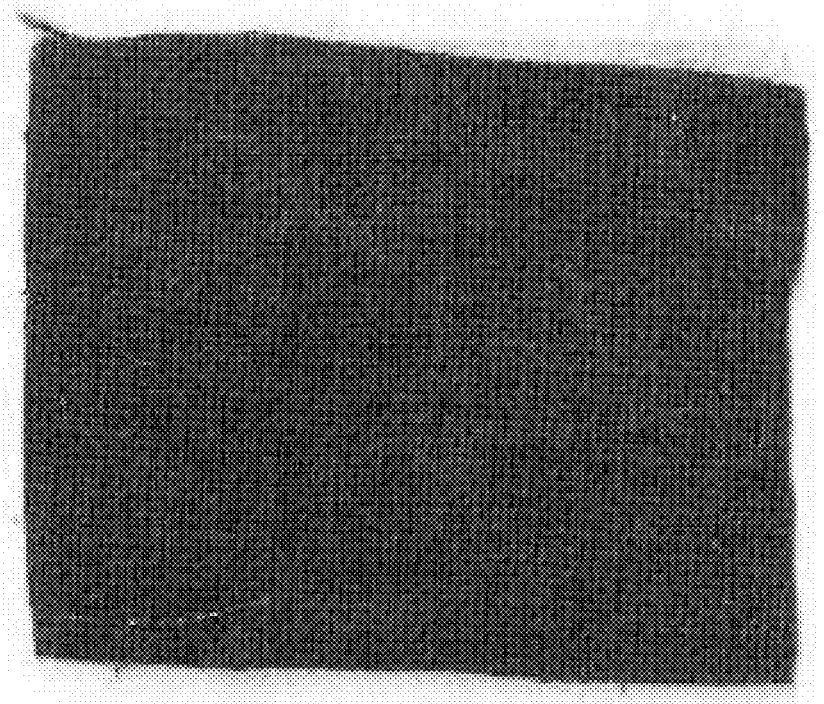
Figure 6:
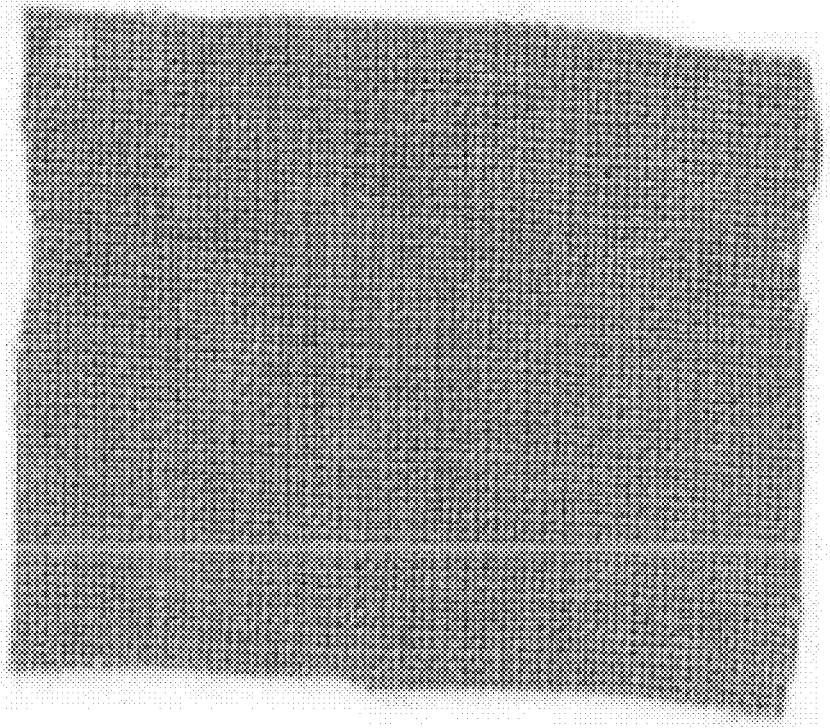
Figure 7:
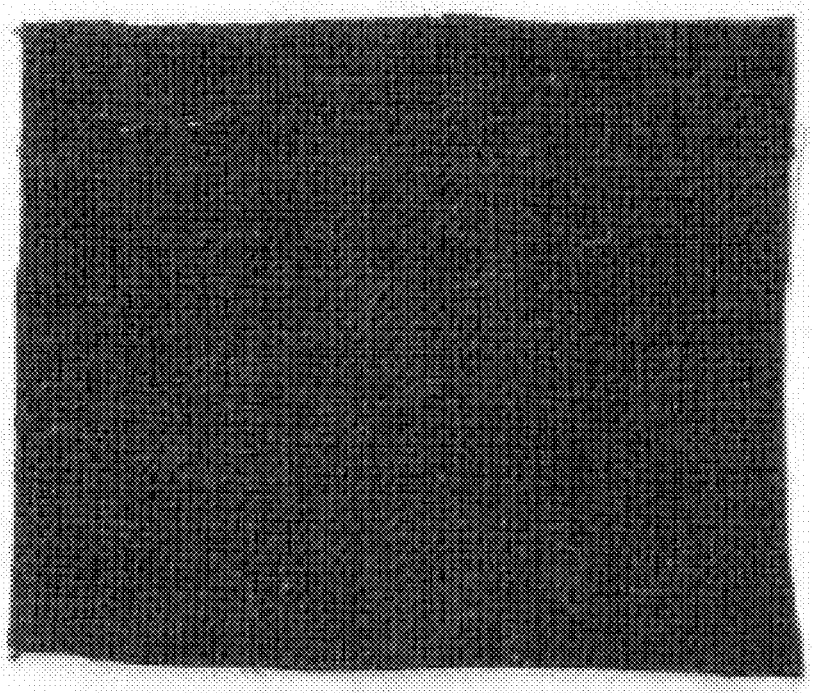
Figure 7:
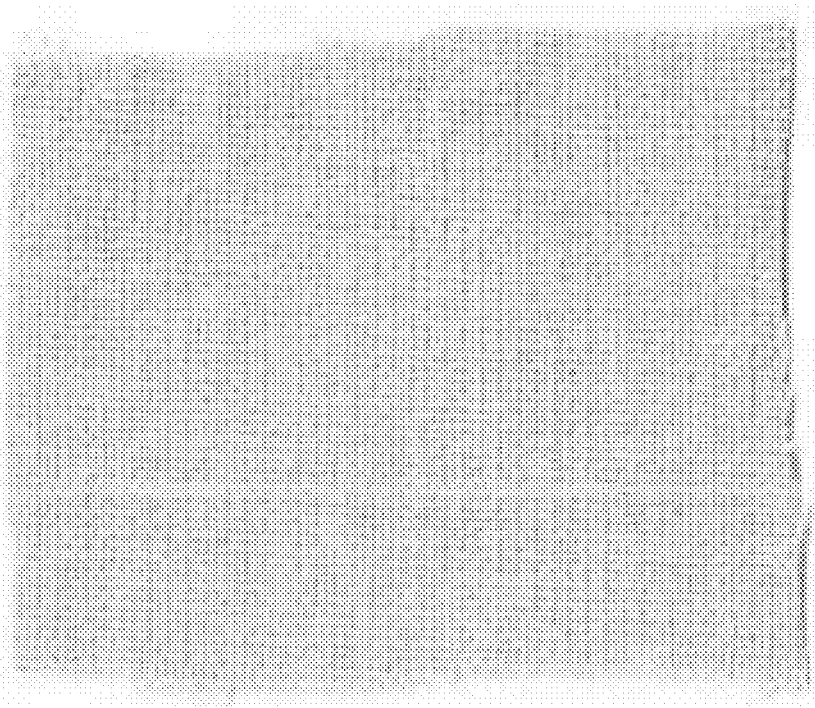
Figure 8:
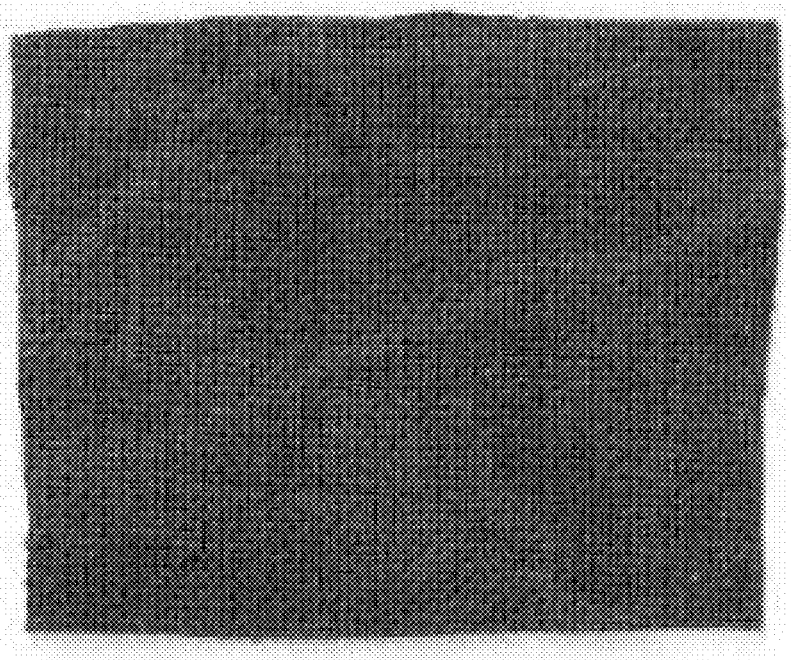
Figure 8:
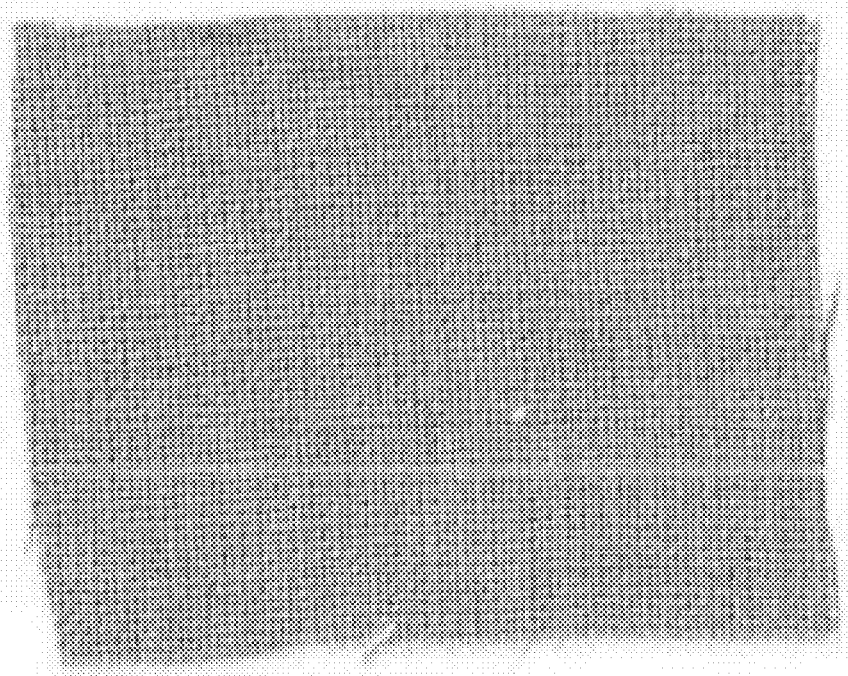
Figure 9:
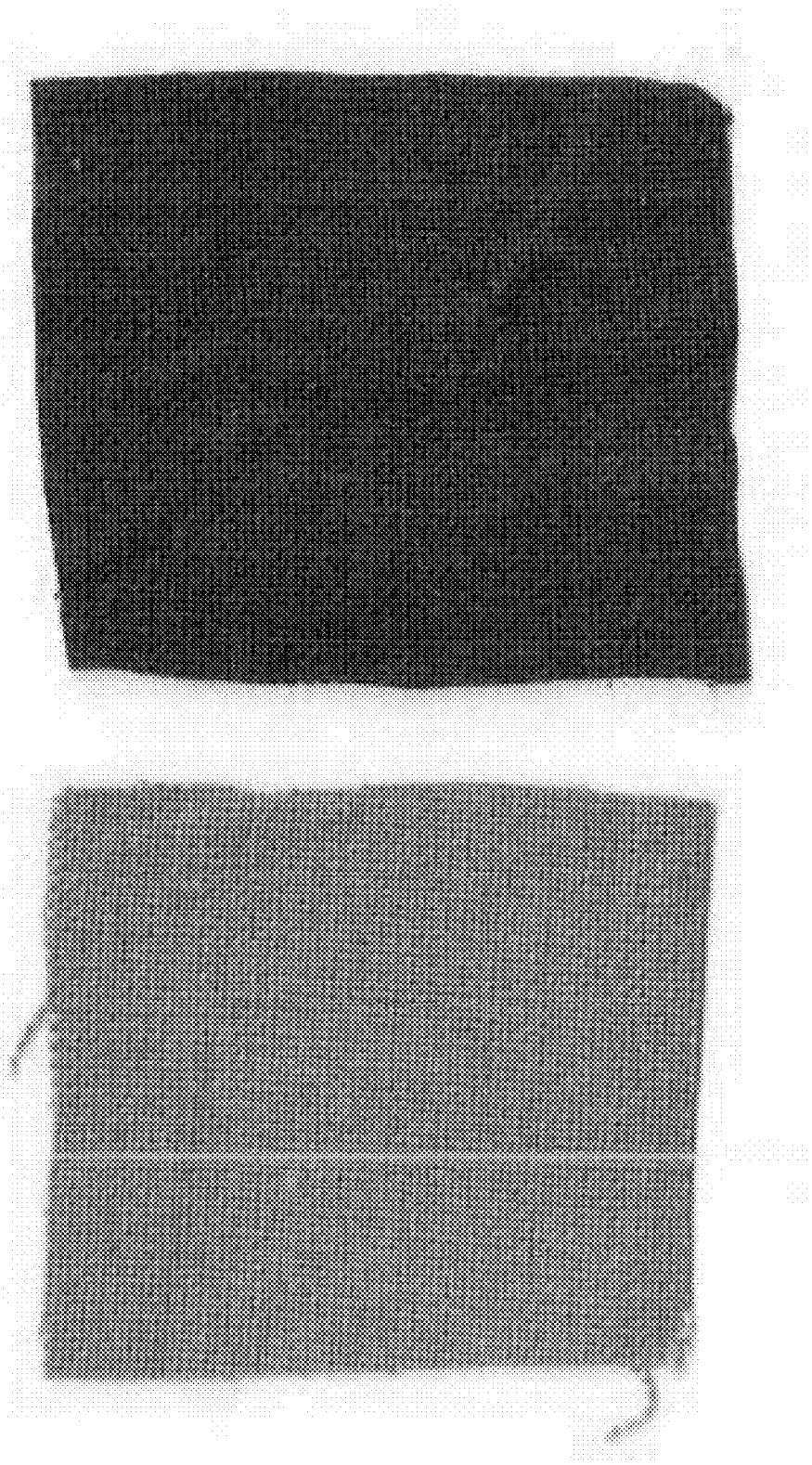
Figure 10:
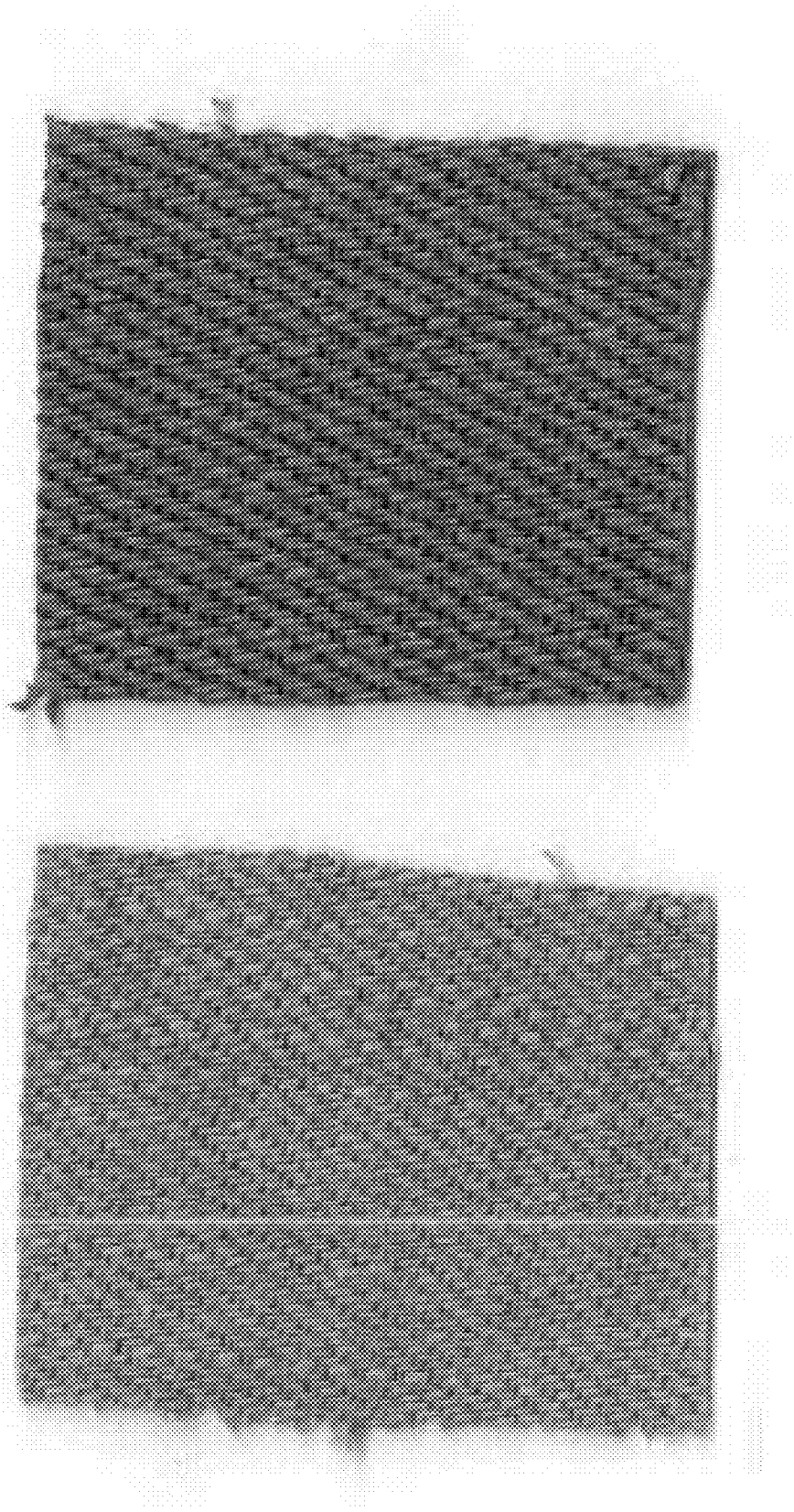

| 1 | 2 | 3 | 4 | 5 | 6 | 7 | 8 | 9 | 10 |
|---|---|---|---|---|---|---|---|---|---|
| Annatto | Gall | Mallotus Japonicus | Acacia | Rhubarb | Sandal wood | Madder | Pomegranate | Catechu | Persimmon Tannin |
| FIG. 1 | FIG. 2 | FIG. 3 | FIG. 4 | FIG. 5 | FIG. 6 | FIG. 7 | FIG. 8 | FIG. 9 | FIG. 10 |

When the fabric having undergone the ferro-mordanting process is put into the solution in which potassium ferrocyanide dissolves, color of the fabric is changed to blue according to a time lapse. A density of blue is changed according to the time lapse of the fabric impregnated with the solution. Therefore, the impregnated time of fabric with the solution may be a factor deciding the impression of color and the density of color etc., including a factor of the above-described selection of raw dye.

In accordance with the embodiment of the invention described above, fabric dyed with a blue group can be approached using natural dyes, which was difficult to approach it in a conventional art, thereby resulting in a stabilized coloring effect.

Dyeing steps using some of the above-mentioned natural dyes and their results are described with experimental examples, as follows.

Experimental Example

Dyeing for Raising Blue, Using Natural Dye

1) Selection of dyes

Dyes selected in the present experiment are as the following table 1.

TABLE 1

| 1 | 2 | 3 | 4 | 5 | 6 | 7 | 8 | 9 | 10 |
|---|---|---|---|---|---|---|---|---|---|
| Annatto | Gall | Mallotus Japonicus | Acacia | Rhubarb | Sandal wood | Madder | Pomegranate | Catechu | Persimmon Tannin |

2) Dyeing of raw dyes

Fabric was dyed using the above respective natural dyes in a general scheme based on respective dye.

3) Ferro-mordanting $FeSO_4$ was prepared by a rate of 3 to 5 weight percent to 100 weight percent of fabric, and dissolved in water, and then As shown in the drawings, the upper drawing represents a state of revealing a color of blue group after the above all procedures in accordance with the embodiment of the invention, and the lower drawing represents a color dyed by raw dye before treating the fabric with ferro-mordant. Regardless of the dyeing state of raw dye with various colors, they are all dyed with the blue group and their coloring expressions become finely different from one another.

It will be apparent to those skilled in the art that modifications and variations can be made in the inventive concept without deviating from the spirit or scope of the inventive concept. Thus, it is intended that the inventive concept cover any such modifications and variations of the inventive concept provided they come within the scope of the appended claims and their equivalents.

INDUSTRIAL APPLICABILITY

In the drawings and specification, there have been disclosed typical embodiments of the inventive concept and, although specific terms are employed, they are used in a generic and descriptive sense just and not for limitation, the scope of the inventive concept being set forth in the following claims.

What is claimed is:

1. A dyeing method for raising a blue color, comprising:

dyeing fabric with raw dye wherein the raw material of the dye is at least one of persimmon, madder, gardenia, chestnut, gromwell, gall, annatto, *mallotus japonicus*, acacia, rhubarb, sandalwood, pomegranate, catechu and wine;

ferro-mordanting the fabric having undergone the dyeing of raw dye with ferro-mordant;

producing potassium ferrocyanide solution by dissolving potassium ferrocyanide in water; and putting the fabric having undergone the mordanting of ferro-mordant into the solution obtained in the potassium ferrocyanide solution production and then ripening the fabric until a blue color of a desired tone is raised.

2. The method of claim 1, wherein the raw material of the dyes is at least one of persimmon, madder, gardenia, chestnut, gromwell, gall, annatto, *mallotus japonicus*, acacia, rhubarb, sandalwood, pomegranate, catechu and wine.

3. The method of claim 1, wherein the ferro-mordanting comprises:

putting ferro-mordant agent in water of normal temperature and dissolving it;

impregnating the fabric having undergone the dyeing of raw dye with solution obtained through the ferro-mordant agent dissolving; and slowly increasing temperature of the solution to 50° C. to 100° C. after the fabric impregnation.

4. The method of claim 1 or 3, wherein the ferro-mordant agent used in the ferro-mordanting is $FeSO_4$.

5. The method of claim 4, wherein the $FeSO_4$ used in the ferro-mordanting has 1 to 20 weight percent to 100 weight percent of the fabric.

6. The method of claim 1, wherein the potassium ferrocyanide used in the potassium ferrocyanide solution production has 1 to 20 weight percent to 100 weight percent of the fabric.

* * * * *